US007297029B2

(12) United States Patent
Ueno et al.

(10) Patent No.: US 7,297,029 B2
(45) **Date of Patent: *Nov. 20, 2007**

(54) COMMUNICATION CONTROL IC-INCORPORATING CONNECTOR AND WIRING HARNESS WITH COMMUNICATION CONTROL IC-INCORPORATING CONNECTOR

(75) Inventors: Seiichi Ueno, Tokyo (JP); Takenobu Yabu, Tokyo (JP); Shigeharu Aoyagi, Tokyo (JP); Hirotomo Shiozaki, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 79 days.

This patent is subject to a terminal disclaimer.

(21) Appl. No.: 11/368,384

(22) Filed: Mar. 7, 2006

(65) Prior Publication Data

US 2006/0211307 A1 Sep. 21, 2006

(30) Foreign Application Priority Data

Mar. 9, 2005 (JP) ..... 2005-066216
Sep. 2, 2005 (JP) ..... 2005-255630

(51) Int. Cl.
*H01R 33/945* (2006.01)

(52) U.S. Cl. ..... 439/620.21; 439/404; 439/925

(58) Field of Classification Search ..... 439/620.01, 439/620.21, 620.09, 404, 658, 925
See application file for complete search history.

(56) References Cited

U.S. PATENT DOCUMENTS 5,037,308 A * 8/1991 Bryce et al. ..... 439/52
5,125,846 A * 6/1992 Sampson et al. ..... 439/66
5,501,611 A * 3/1996 Staiger et al. ..... 439/404
6,991,496 B2 * 1/2006 Kuribayashi et al. .. 439/620.04
2004/0074665 A1 * 4/2004 Sugaya et al. ..... 174/72 A

FOREIGN PATENT DOCUMENTS

JP 2004-172072 6/2004

* cited by examiner

*Primary Examiner*—Tho D. Ta
(74) *Attorney, Agent, or Firm*—Oblon, Spivak, McClelland, Maier & Neustadt, P.C.

(57) ABSTRACT

There is provided a communication control IC-incorporating connector characterized in that a communication control IC is incorporated in a housing; an equipment-side connecting portion for connecting the equipment-side lead of the IC to the male terminal of an equipment-side connector is provided in the interior on the front end side of the housing, and a bus wiring-side connecting portion for connecting the bus wiring-side lead of the IC to the electric wire of a bus wiring circuit is provided in the interior on the rear end side of the housing; and in the equipment-side connecting portion, a two-way female connecting terminal in which the equipment-side lead inserting portion of the IC and the male terminal inserting portion of the equipment-side connector are provided alternately is incorporated.

13 Claims, 13 Drawing Sheets

COMMUNICATION CONTROL IC-INCORPORATING CONNECTOR AND WIRING HARNESS WITH COMMUNICATION CONTROL IC-INCORPORATING CONNECTOR

TECHNICAL FIELD

The present invention relates to a connector incorporating a communication control IC (integrated circuit), which is used for a wire harness or the like, and a wiring harness with communication control IC-incorporating connector that uses the said connector.

BACKGROUND OF THE INVENTION

A motor vehicle is mounted with a large number of actuators formed by a motor, a relay, a solenoid, and the like as electric equipment, and a control system for decentralized controlling the electric equipment independently by means of data communication has already been developed. In this system, a wire harness as shown in FIG. 17 is used. This wire harness 10 is constructed by installing a plurality of connectors 14 on a combination wire 12, in which a plurality of electric insulated wires are collected, at desired intervals in the lengthwise direction, and is called a so-called bus wiring wire harness. Each of the connectors 14 in this wire harness 10 is inserted in and connected to a connector 18 (equipment-side connector) on the electric equipment 16 side mounted at portions of a vehicle.

The connector 14 on the wire harness 10 side incorporates a circuit board that distinguishes a signal (address) to the electric equipment to which the connector 14 is connected from signals transmitting on the combination wire 12 to carry out the control of the electric equipment (Unexamined Japanese Patent Publication No. 2004-172072). The connector of this type is also called a smart connector.

In the conventional circuit board-incorporating connector, a female terminal in which a male terminal of the equipment-side connector is inserted is connected to a circuit board by soldering, and a solderless terminal to which an electric wire is connected is also connected to the circuit board by soldering.

In recent years, the incorporating of a communication control IC in place of the circuit board has been studied. In this case, however, since the lead of the communication control IC is connected by soldering to the female terminal in which the male terminal of the equipment-side connector is inserted, the inserting/drawing force of the male terminal is unfavorably applied to the lead of the IC.

Also, in the conventional circuit board-incorporating connector, after the circuit board has been incorporated in a connector housing, soldering between the female terminal and the circuit board and soldering between the solderless terminal and the circuit board are performed (namely, the circuit board is incorporated at an early stage of a connector assembling process). Therefore, if a trouble is found during the assembly of connector, there is high possibility that the circuit board becomes wasteful. Also, if a trouble is found after the assembly of connector or after the assembly of wire harness, it is difficult to recover the circuit board. Since the communication control IC is more expensive than the circuit board, if a trouble is found after the communication control IC has been incorporated in the housing and the communication control IC becomes wasteful, the yield of assembling process is decreased, which results in an increase in cost.

SUMMARY OF THE INVENTION

A communication control IC-incorporating connector in accordance with the present invention is characterized in that a communication control IC is incorporated in a housing; an equipment-side connecting portion for connecting the equipment-side lead of the IC to the male terminal of an equipment-side connector is provided in the interior on the front end side of the housing, and a bus wiring-side connecting portion for connecting the bus wiring-side lead of the IC to the electric wire of a bus wiring circuit is provided in the interior on the rear end side of the housing; and in the equipment-side connecting portion, a two-way female connecting terminal in which the equipment-side lead inserting portion of the IC and the male terminal inserting portion of the equipment-side connector are provided alternately is incorporated.

Also, a wiring harness with communication control IC-incorporating connector in accordance with the present invention is a wiring harness in which the communication control IC-incorporating connectors described above is installed to the electric wire of a bus wiring circuit.

DETAILED DESCRIPTION OF THE INVENTION

EMBODIMENT 1

Figure 1:
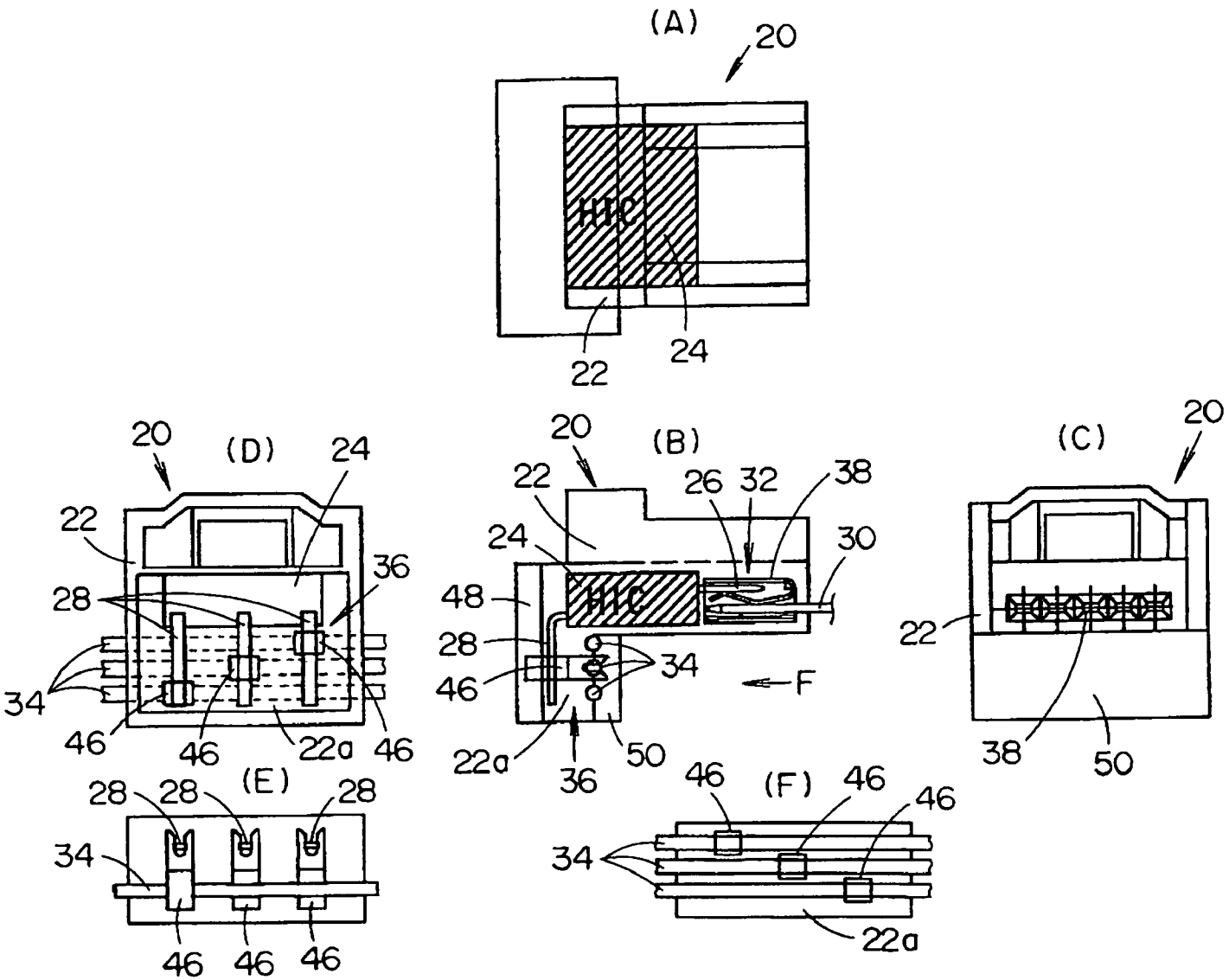
FIG. 1 is views showing one embodiment of a communication control IC-incorporating connector in accordance with the present invention, FIG. 1(A) being a see-through plan view, FIG. 1(B) being a see-through side view, FIG. 1(C) being a front view, FIG. 1(D) being a back view showing a state in which a back lid is removed, FIG. 1(E) being a see-through bottom view of an essential portion, and FIG. 1(F) being a front view taken in F direction in FIG. 1(B) by removing a front lid.
Figure 2:
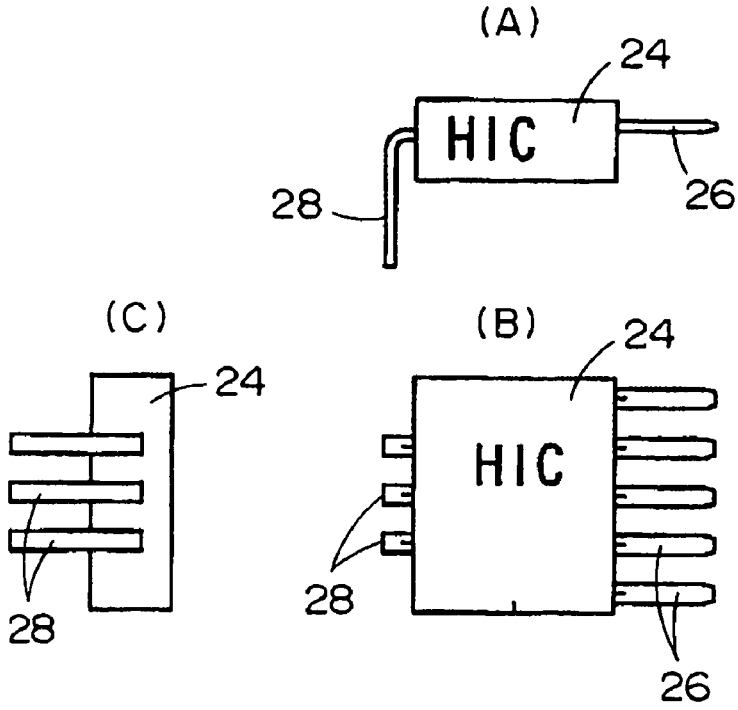
FIG. 2 is views showing a communication control IC used in the connector shown in FIG. 1, FIG. 2(A) being a side view, FIG. 2(B) being a plan view, and FIG. 2(C) being a back view.
Figure 17:
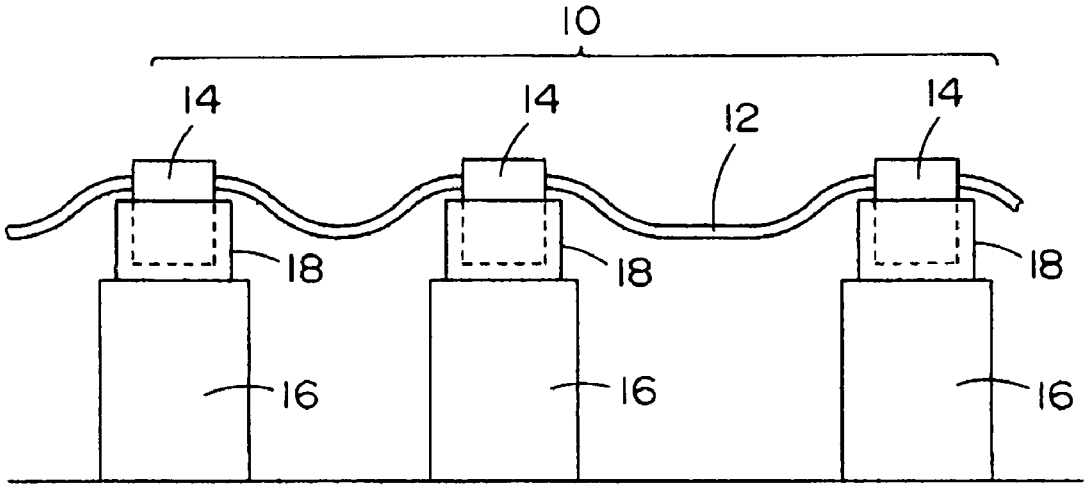
FIG. 17 is an explanatory view showing a state in which a bus wiring wire harness is being used.

FIG. 1 shows one embodiment of the present invention. This communication control IC-incorporating connector 20 incorporates a communication control IC 24 in a housing 22, and is used in the same way as the circuit board-incorporating connector 14 shown in FIG. 17. For example, as shown in FIG. 2, the communication control IC 24 has five equipment-side leads 26 on the front end side thereof and three bus wiring-side leads 28 on the rear end side thereof. The bus wiring-side leads 28 are bent at right angles to the lengthwise direction of the equipment-side leads 26.

In the interior on the front side of the housing 22, an equipment-side connecting portion 32 for connecting the equipment-side leads 26 of the communication control IC 24 to a male terminal 30 of an equipment-side connector is provided, and in the interior on the rear side thereof, a bus wiring-side connecting portion 36 for connecting the bus wiring-side leads 28 of the communication control IC 24 to electric wires 34 of a bus wiring circuit is provided.

Figure 3:
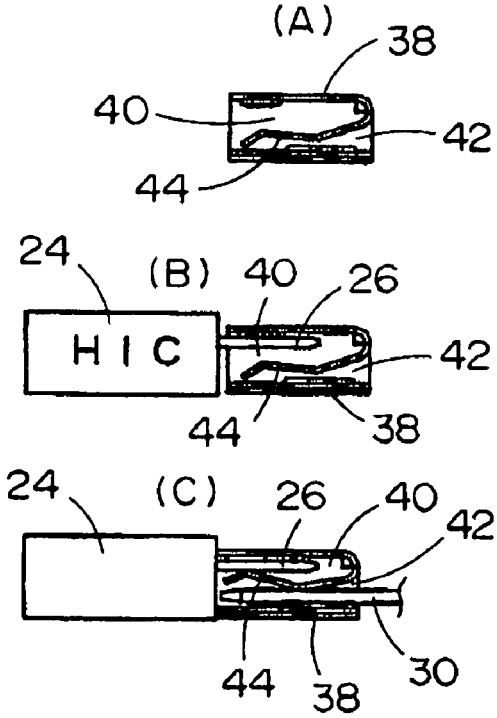
FIG. 3 is views showing a two-way female connecting terminal used in the connector shown in FIG. 1, FIG. 3(A) being a sectional view, FIG. 3(B) being a sectional view showing a state in which equipment-side leads of a communication control IC is inserted, and FIG. 3(C) being a sectional view showing a state in which a male terminal of an equipment-side connector is further inserted.

In the equipment-side connecting portion 32, a two-way female connecting terminal 38 as shown in FIG. 3(A) is incorporated. The two-way female connecting terminal 38 is provided an insertion portion 40 for the equipment-side leads 26 of the communication control IC 24 and an insertion portion 42 for the male terminal 30 of the equipment-side connector in the direction different from each other. Between the insertion connectors 40 and 42, an elastic tongue element 44 folded from the inlet side of the insertion portion 42 is provided. This elastic tongue element 44 is formed so that in the state in which the equipment-side leads 26 of the communication control IC 24 are inserted in the insertion portion 40 and the male connector of the equipment-side connector is not inserted in the insertion portion 42 as shown in FIG. 3(B), the elastic tongue element 44 does not come into contact with the equipment-side leads 26, but if the male terminal 30 is inserted in the insertion portion 42 as shown in FIG. 3(C), the elastic tongue element 44 is pushed away by the male terminal 30 and comes into contact with the equipment-side leads 26, by which an elastic repulsive force necessary for electrical connection is generated. The elastic tongue element 44 may be formed so that when the equipment-side leads 26 are inserted as shown in FIG. 3(B), the elastic tongue element 44 comes into contact with the equipment-side leads 26 with a contact pressure lower than the contact pressure necessary for electrical connection.

The two-way female connecting terminal 38 is incorporated in the housing 22 before the communication control IC 24 is incorporated in the housing 22. When the communication control IC 24 is incorporated in the housing 22, as shown in FIG. 3(B), the equipment-side leads 26 do not come into contact with the elastic tongue element 44 (or come into contact merely with a low contact pressure), so that the equipment-side leads 26 can be inserted in the two-way female connecting terminal 38 with no insertion force (or with a small insertion force). Also, when the assembled connector 20 is fitted in the equipment-side connector (when a wire harness is incorporated in a vehicle), the two-way female connecting terminal 38 incorporated in the housing 22 receives the insertion force of the male terminal 30, so that the insertion force is not exerted on the equipment-side leads 26 of the communication control IC 24. Therefore, the communication control IC 24 can be protected securely.

On the other hand, as shown in FIG. 1(B), the bus wiring-side connecting portion 36 is provided with a portion 22*a* projecting downward on the rear end side of the housing 22. On the rear surface of a downward projecting portion 22*a* of the housing, the bus wiring-side leads 28 of the communication control IC 24, which extend downward, are located, and on the front surface thereof, a plurality of electric wires 34 (formed by separating the combination wire of wire harness) constituting the bus wiring are arranged in the direction intersecting with the bus wiring-side leads 28. The leads 28 and the electric wires 34, which are to be connected to each other, are connected at a cross portion of them via a cross connector 46.

The cross connector 46 has a solderless terminal for connecting the lead 28 under pressure to one side, and has a solderless terminal for connecting the electric wire 34 to the other end side. The solderless terminal at both ends is formed so that the direction of groove is at right angles. The cross connector 46 is installed to the downward projecting portion 22*a* of the housing 22 before the communication control IC 24 and the electric wires 34 are incorporated. The bus wiring-side leads 28 are connected under pressure to the solderless terminal on one end side of the cross connector 46 when the communication control IC 24 is incorporated in the housing 22. The direction in which the bus wiring-side leads 28 are pushed in the solderless terminal on one end side of the cross connector 46 and the direction in which the equipment-side leads 26 are inserted in the two-way female connecting terminal 38 are the same. Therefore, the connection under pressure of the bus wiring-side lead 26 to the cross connector 46 and the insertion of the equipment-side leads 28 into the two-way female connecting terminal 38 can be carried out at the same time, so that the communication control IC 24 can be incorporated easily. Also, the incorporated communication control IC 24 can be removed from the housing 22.

After the communication control IC 24 has been incorporated in the housing 22, a back lid 48 is mounted on the rear end surface of the housing 22. Also, after the electric wires 34 have been connected under pressure to the cross connector 46, a front lid 50 is mounted on the front surface of the downward projecting portion 22*a* of the housing. In the facing surface between the downward projecting portion 22*a* of the housing and the front lid 50, guide grooves for the electric wires 34 are formed.

The communication control IC 24 may be incorporated in the housing 22 before or after the connector 20 is installed to the electric wires 34. In the latter case, the most expensive part is incorporated finally, so that even if defective assembly occurs, damage can be kept at a minimum. Also, since the bus wiring wire harness is formed so that many connectors are installed on one combination wire, if one of the connectors or the communication control IC becomes defective, the whole of wire harness become defective. Even in such a case, the communication control IC can be removed, so that the expensive communication control IC can be recovered and reused. Therefore, the yield of assembling process is improved.

Also, since the communication control IC-incorporating connector 20 is located at a position where the bus wiring side connecting portion 36 is offset from the axis line of engagement between the connector 20 and the equipment-side connector, when the connector 20 is engaged with the equipment-side connector, the bus wiring side connecting portion 36, especially the electric wires 34, does not become a hindrance. Therefore, the connector 20 can easily be assembled to the equipment-side connector automatically, for example, using a robot etc.

Figure 4:
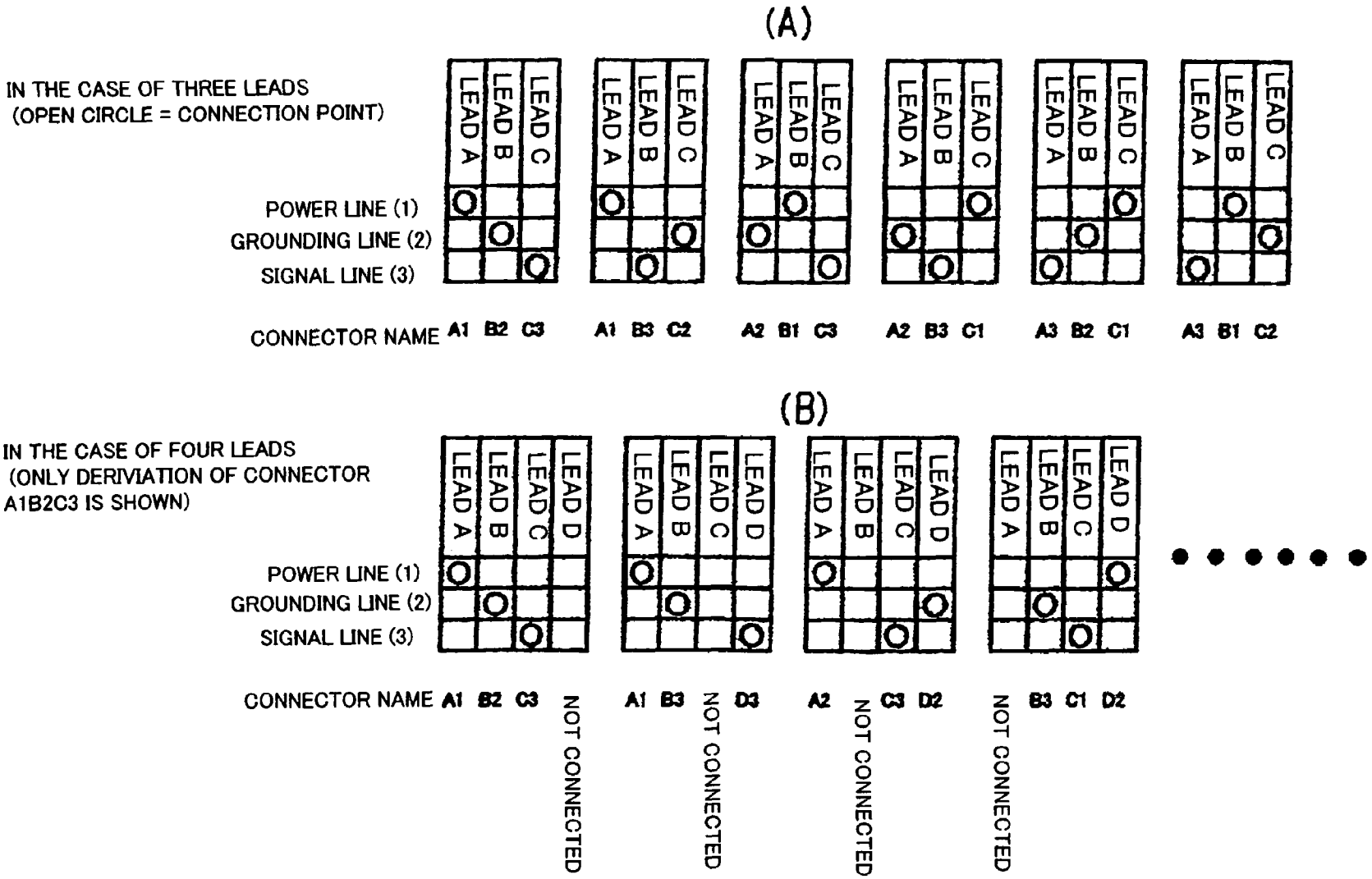
FIG. 4 is an explanatory view showing connection patterns of a communication control IC to a bus wiring-side lead and an electric wire in the connector shown in FIG. 1.

Also, for this communication control IC-incorporating connector 20, since the bus wiring-side leads 28 of the communication control IC 24 and the electric wires 34 are connected to each other at the cross portion thereof via the cross connectors 46 as described above, the number of connection patterns (combination of connection) of the bus wiring-side leads 28 and the electric wires 34 is 3×2×1=6 as shown in FIG. 4(A) in the case where the number of the leads 28 is three and the number of electric wires 34 is three. If the number of the bus wiring-side leads 28 is increased by one, the combination becomes 24 sorts of 4×3×2×1 as shown in FIG. 4(B), so that the utilization of this can determine the address of connector. If the configuration is made such that the address of connector can be identified by the connection pattern of the bus wiring-side leads 28 and the electric wires 34 in this manner, the same communication control IC 24 is manufactured in large quantities and is assembled without being distinguished, and the connection pattern of the bus wiring-side leads 28 and the electric wires 34 is merely changed, by which address can be given. Therefore, the communication control IC 24 can be standardized and can be decreased in cost.

FIG. 1 shows three electric wires 34 constituting the bus wiring. This number of electric wires 34 was determined so as to correspond to three electric wires (power line, grounding line, signal line) shown in FIG. 4. The number of the electric wires 34 is not limited to three.

EMBODIMENT 2

Figure 5:
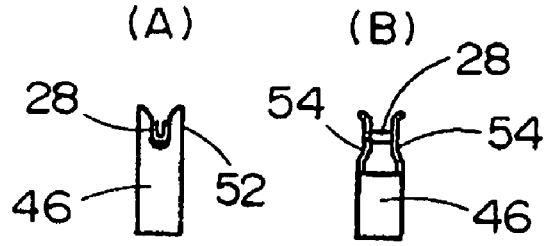
FIGS. 5(A) and 5(B) are views showing another embodiment of a cross connector used in the present invention.

FIG. 5 shows another embodiment of the present invention. FIG. 5(A) shows a case where a portion to which the bus wiring side lead 28 is connected of the cross connector 46 is configured by a connecting terminal 52 for connecting the lead 28 by pushing in the lead 28 curvedly so as to decrease the width. FIG. 5(B) shows a case where a portion to which the bus wiring side lead 28 is connected of the cross connector 46 is configured by a pair of elastic contact elements 54 for connecting the lead 28 by being held. In both cases, the portion for connecting the electric wire of the cross contactor 46 is configured by the solderless terminal as in embodiment 1. The cross contactor 46 can be configured in this manner.

EMBODIMENT 3

Figure 6:
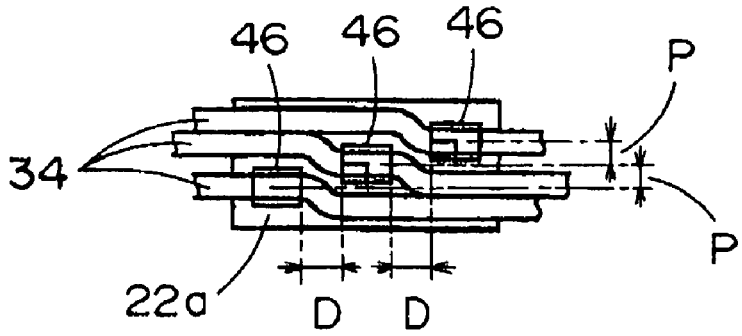
FIG. 6 is a front view showing another embodiment of a connection state between an electric wire and a cross connector, which is used in the present invention.

FIG. 6 shows still another embodiment of the present invention. FIG. 6 corresponds to FIG. 1(F). In this embodiment, in the bus wiring-side connecting portion 36, a plurality of cross connectors 46 are arranged by shifting the positions thereof so that the arrangement pitch P is equivalent to the wire diameter in the lead lengthwise direction with intervals D being provided in the lengthwise direction of the electric wire 34 (the bend of the electric wire 34 is allowed).

By doing this, the height dimension of the downward projecting portion 22*a* of the housing can be decreased, so that the size of connector can be reduced.

EMBODIMENT 4

Figure 7:
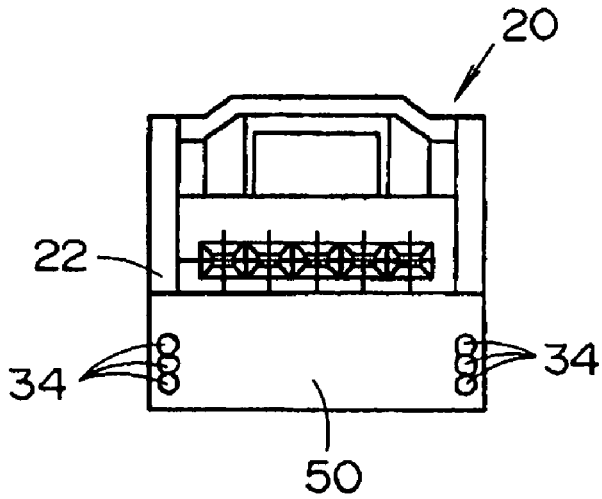
FIG. 7 is a front view showing a still another embodiment of a communication control IC-incorporating connector in accordance with the present invention.

FIG. 7 shows still another embodiment of the present invention. In this embodiment, the electric wires 34 passing through the downward projecting portion 22*a* of the housing 22 are pulled out toward the tip end side (front side) of the connector 20. By doing this, a state is formed in which when the connector 20 is connected to the equipment-side connector, the electric wires 34 are pulled out of the connector 20 toward the electrical equipment side, so that there is little possibility that the electric wires 34 are suspended in midair, and thereby damage caused by the hooking of wire can be prevented.

EMBODIMENT 5

Figure 8:
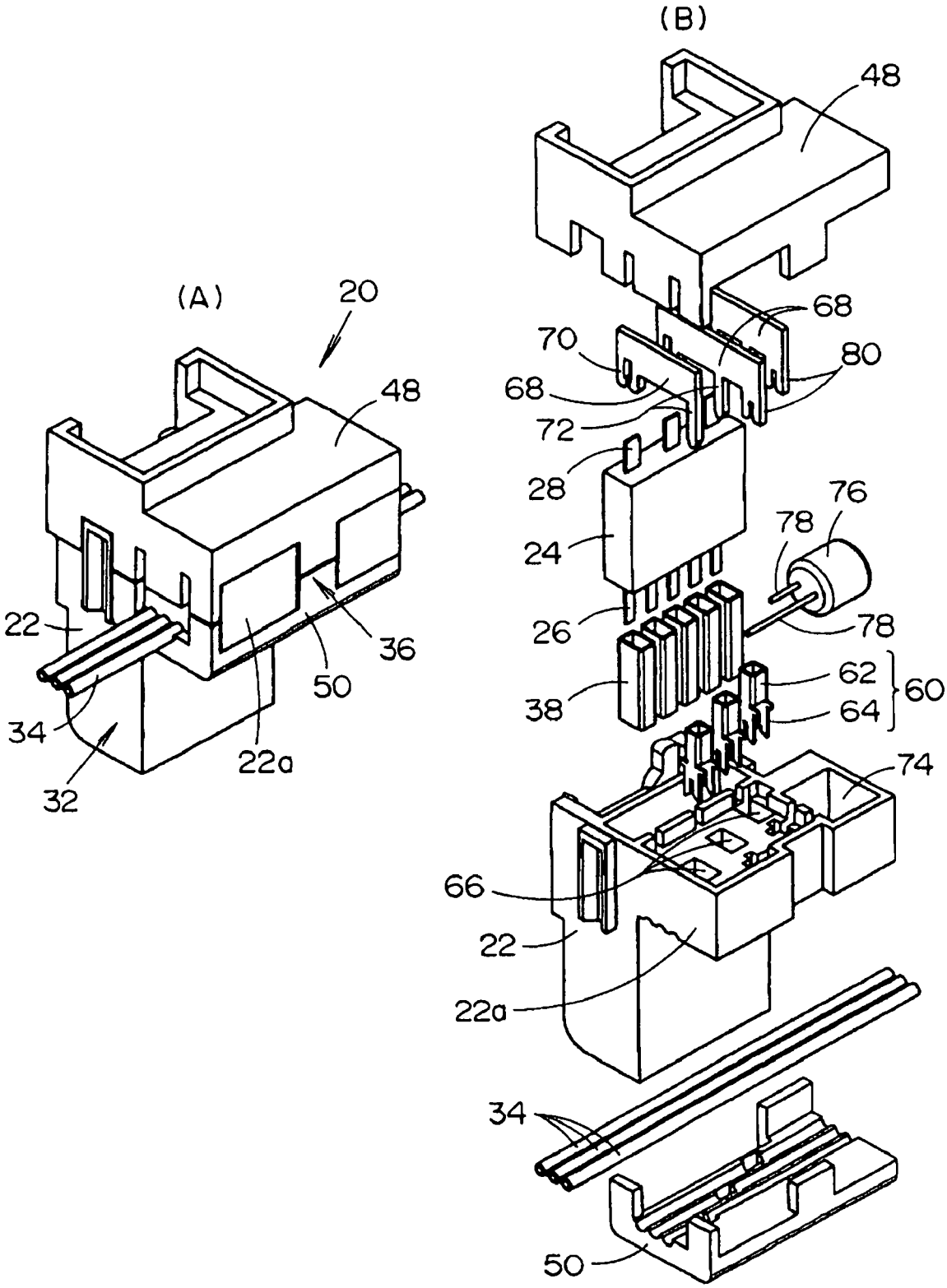
FIG. 8 is views showing still another embodiment of a communication control IC-incorporating connector in accordance with the present invention, FIG. 8(A) being an appearance perspective view, and FIG. 8(B) being an exploded perspective view.
Figure 9:
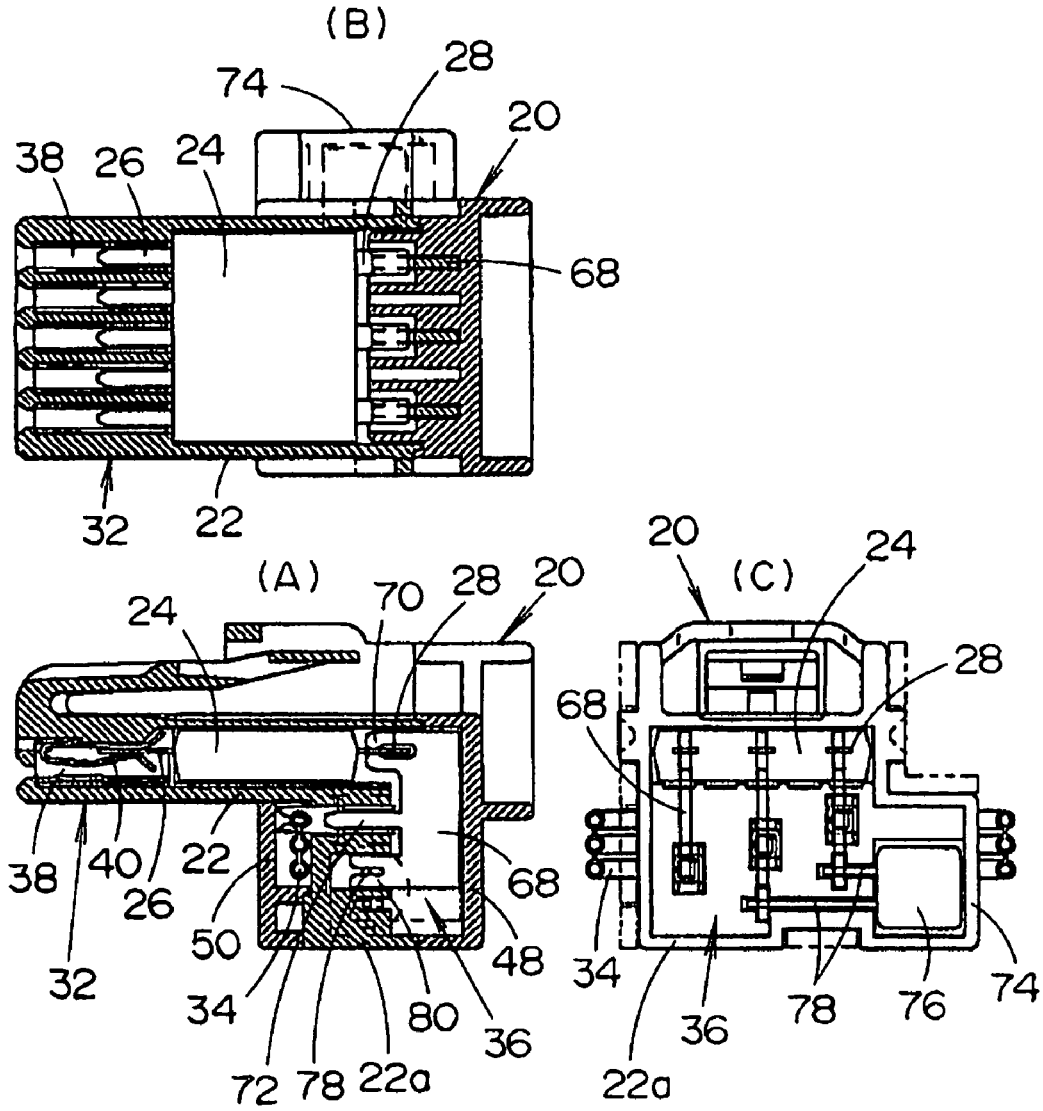
FIG. 9 is views showing the connector shown in FIG. 8, FIG. 9(A) being a longitudinal sectional view, FIG. 9(B) being a transverse sectional view, and FIG. 9(C) being a back view showing a state in which a back lid is removed.

FIGS. 8 and 9 show still another embodiment of the present invention. FIGS. 8(A) and 8(B) are drawn so that the front end side of the housing 22 is directed to the downside and the rear end side to the upside, and FIGS. 9(A) and 9(B) are drawn so that the front end side of the housing 22 is directed to the left side and the rear end side to the right side. In the housing 22, the communication control IC 24 is incorporated. The communication control IC 24 used in this embodiment has five equipment-side leads 26 on the front end side thereof and three bus wiring-side leads 28 on the rear end side thereof as shown in FIG. 8(B). This embodiment differs from embodiment 1 in that the bus wiring-side leads 28 extend in a straight line shape in the direction opposite to the equipment-side leads 26.

In the interior on the front end side of the housing 22, there is provided the equipment-side connecting portion 32 for connecting the equipment-side leads 26 of the communication control IC 24 to the male terminal (corresponding to reference numeral 30 in FIG. 3, not shown here) of the equipment-side connector, and in the interior on the rear end side of the housing 22, there is provided the bus wiring-side connecting portion 36 for connecting the bus wiring-side leads 28 of the communication control IC 24 to the electric wires 34 of the bus wiring circuit. This respect is the same as embodiment 1.

In the equipment-side connecting portion 32, the two-way female connecting terminal 38 configured in the same way as embodiment 1 is incorporated in the same way as embodiment 1.

On the other hand, as in embodiment 1, the bus wiring-side connecting portion 36 is provided with the portion 22*a* projecting downward (front side in FIG. 8) on the rear end side of the housing 22. In the downward projecting portion 22*a* of the housing 22, three (the same number as the number of the bus wiring-side leads 28 of the communication control IC 24) wire connectors 60 are incorporated. The wire connector 60 has a female terminal 62 connected to the bus wiring-side lead 28 on one end side thereof and has a solderless terminal 64 connected under pressure to the electric wire on the other end side thereof. In the downward projecting portion 22*a* of the housing 22, through holes 66 for housing the wire connectors 60 are formed. When the wire connectors 60 are inserted in the through holes 66, the female terminals 62 of the wire connectors 60 are positioned so as to be in parallel with the bus wiring-side leads 28 of the communication control IC 24.

On the front surface (surface on the front end side of the housing 22) of the downward projecting portion 22*a* of the housing 22, three electric wires 34 (may be a band-shaped electric wire having three conductors) are arranged so as to be at right angles to the three wire connectors 60. The three electric wires 34 are connected to the solderless terminals 64 of the three wire connectors 60. The through holes 66 for housing the wire connectors 60 are formed by shifting the positions thereof in accordance with the arrangement pitch of the electric wires 34 so that the three wire connectors 60 are connected to the three electric wires 34 one to one. The three electric wires 34 are held at predetermined positions on the front surface of the downward projecting portion 22*a* of the housing 22 by the front lid 50 having the wire guide grooves. This respect is the same as embodiment 1.

Figure 10:
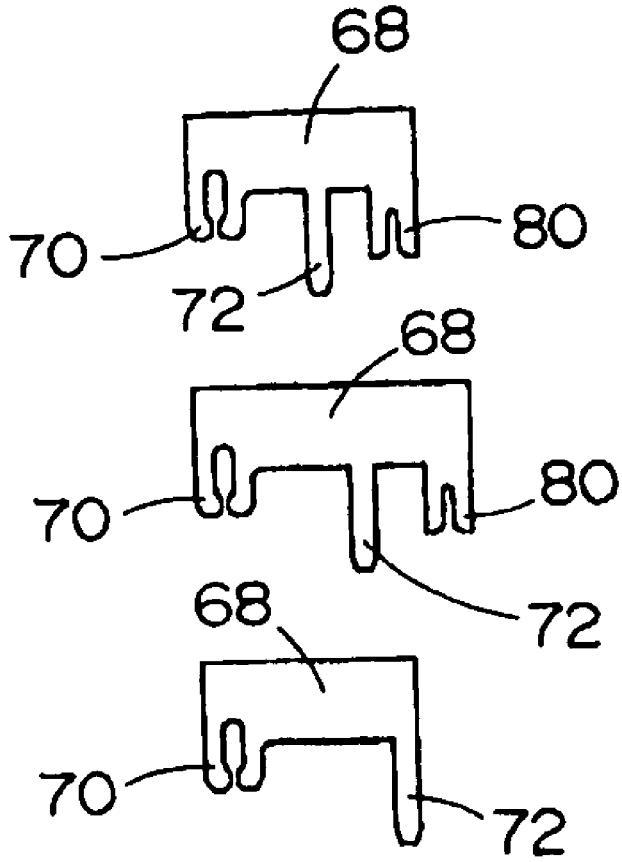
FIG. 10 is a front view of three bridge connectors used in the connector shown in FIG. 8.

The bus wiring-side leads 28 of the communication control IC 24 and the female terminals 62 of the wire connectors, which are arranged in parallel, are connected one to one by three bridge connectors 68 extending between them. Each of the bridge connectors 68 is, as shown in FIG. 10, in a form of a bus bar consisting of a conductive metal sheet, and has a solderless terminal 70 connected under pressure to the bus wiring-side lead 28 of the communication control IC 24 on one end side thereof and a male terminal 72 connected to the female terminal 62 of the wire connector on the other end side thereof. The male terminals 72 of the three bridge connectors 68 are formed by shifting the positions thereof in the wire arrangement direction in accordance with the positions of the female terminals 62 of the three wire connectors. The thus formed bridge connectors 68 are pushed in from the rear end side of the housing 22, by which the bus wiring-side leads 28 of the communication control IC 24 and the female terminals 62 of the wire connectors can be connected electrically one to one. This embodiment is the same as embodiment 1 in that the back lid 48 is mounted on the rear end surface of the housing 22.

In this embodiment, an electrical part housing portion 74 is provided on the side surface of the downward projecting portion 22*a* of the housing 22, and an electrical part 76 such as an electrolytic capacitor is incorporated in the electrical part housing portion 74. The electrical part 76 is incorporated in the housing portion 74 so that the leads 78 extend in the direction at right angles to the bridge connectors 68. On the bridge connector 68 to which the leads 78 of the electrical part 76 is connected, a solderless terminal 80 connected under pressure to the leads 78 is formed on the outside of the male terminal 72 (refer to FIG. 10). Therefore, when the bus wiring-side leads 28 of the communication control IC 24 and the female terminals 62 of the wire connectors are connected to each other with the bridge connectors 68, the leads 78 of the electrical part 76 can be connected at the same time. The electrical part 76 is incorporated as necessary, and is sometimes omitted.

Figure 11:
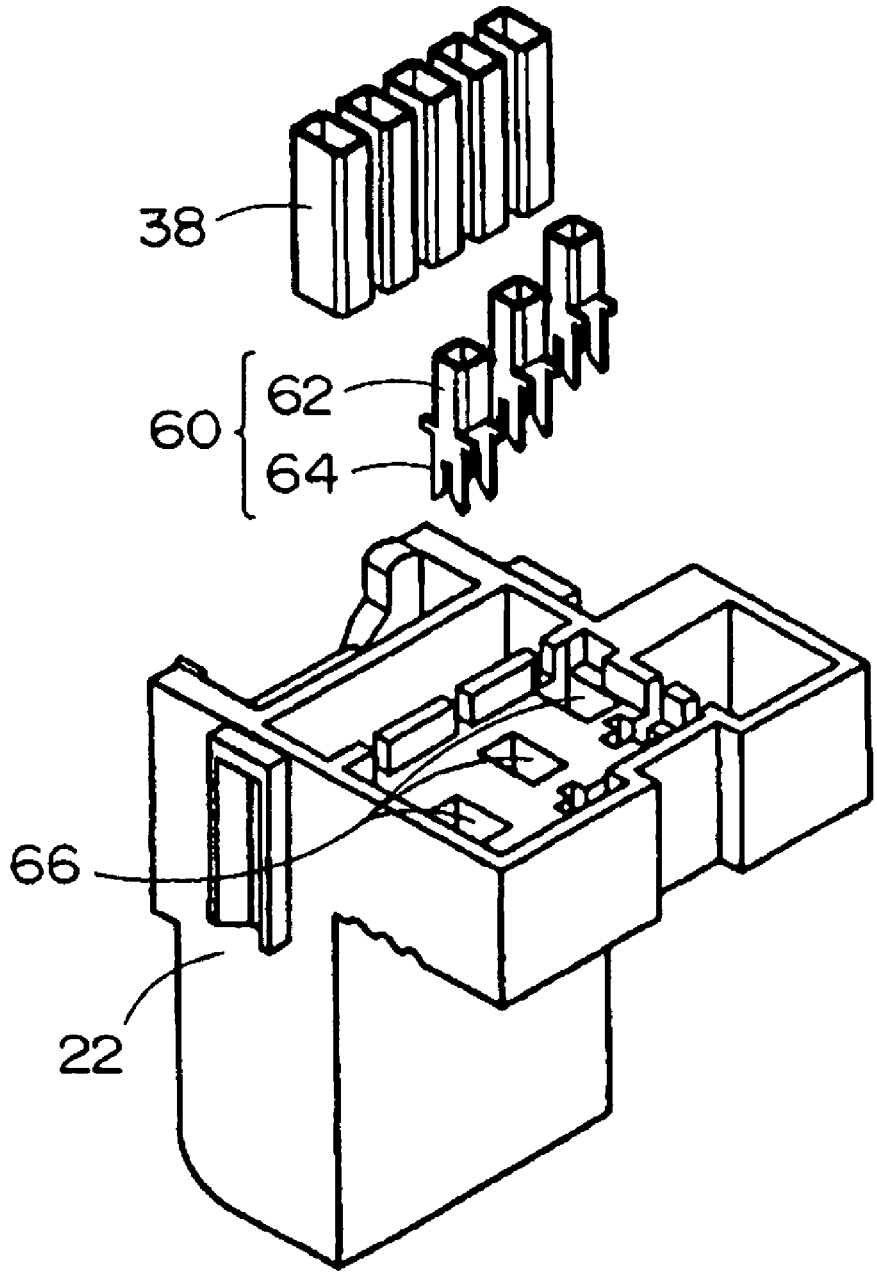
FIG. 11 is a perspective view showing an early state of an assembling process for the connector shown in FIG. 8.
Figure 12:
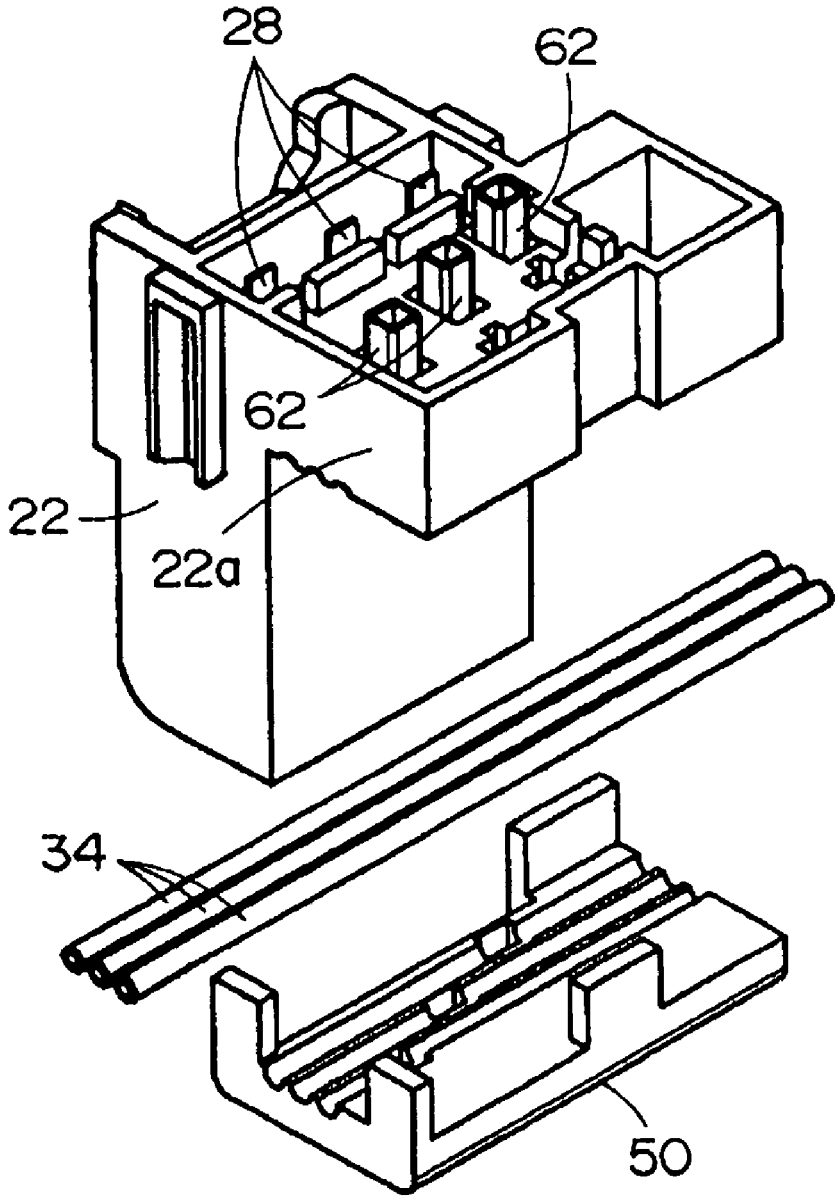
FIG. 12 is a perspective view showing the next state of an assembling process for the connector shown in FIG. 8.

Next, a method for assembling the communication control IC-incorporating connector 20 of this embodiment is explained. First, as shown in FIG. 11, the two-way female connecting terminal 38 is incorporated in the front end portion of the housing 22, and the solderless terminals 64 of the wire connectors 60 are inserted in the through holes 66 in the housing 22. Subsequently, the communication control IC 24 is incorporated in the housing 22, by which the state as shown in FIG. 12 is formed. In FIG. 12, only the bus wiring-side leads 28 of the communication control IC 24 can be seen. When the communication control IC 24 is incorporated, as in embodiment 1, the equipment-side leads 26 can be inserted in the two-way female connecting terminal 38 with no insertion force (or with a very small insertion force in the case where the elastic tongue element 44 of the two-way female connecting terminal 38 is lightly in contact with the equipment-side leads 26 as shown in FIG. 9(A)). Therefore, the communication control IC 24 can be attached or detached with a small force, so that there is little fear of damaging the expensive communication control IC 24 when the communication control IC 24 is attached or detached.

Figure 13:
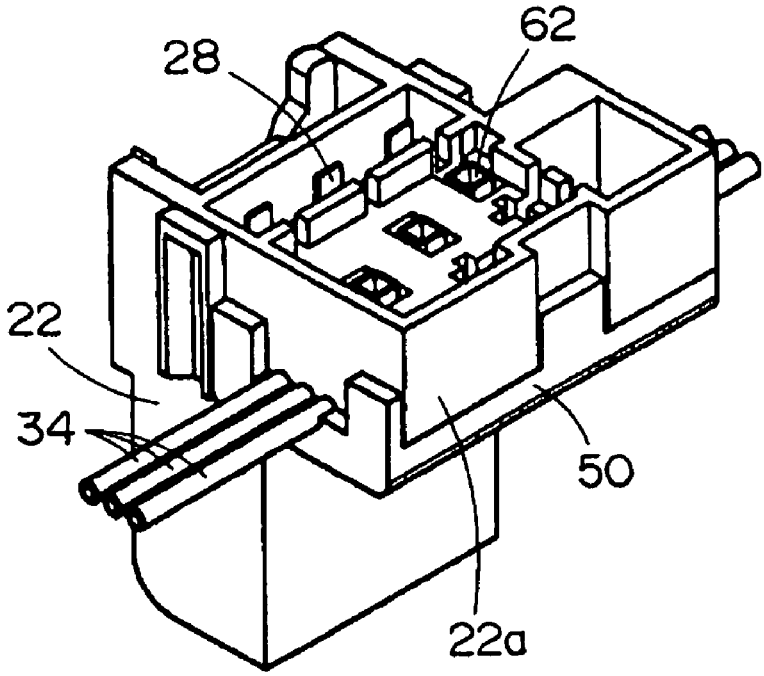
FIG. 13 is a perspective view showing the next state of an assembling process for the connector shown in FIG. 8.

Thereafter, as shown in FIG. 12, the electric wires 34 are arranged on the front surface of the downward projecting portion 22*a* of the housing 22, and the front lid 50 is installed to the housing 22, by which the electric wires 34 are fixed at predetermined positions as shown in FIG. 13. When the wire connectors 60 are pushed in in this state, the solderless terminals 64 of the wire connectors 60 and the electric wires 34 are connected electrically to each other. The communication control IC 24 may be incorporated after the wire connectors 60 and the electric wires 34 have been connected to each other.

Figure 14:
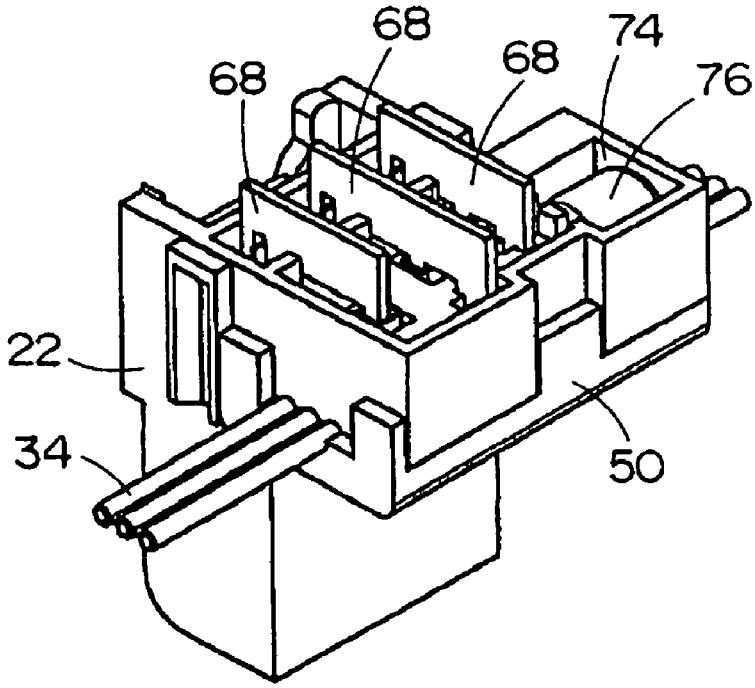
FIG. 14 is a perspective view showing the next state of an assembling process for the connector shown in FIG. 8.
Figure 15:
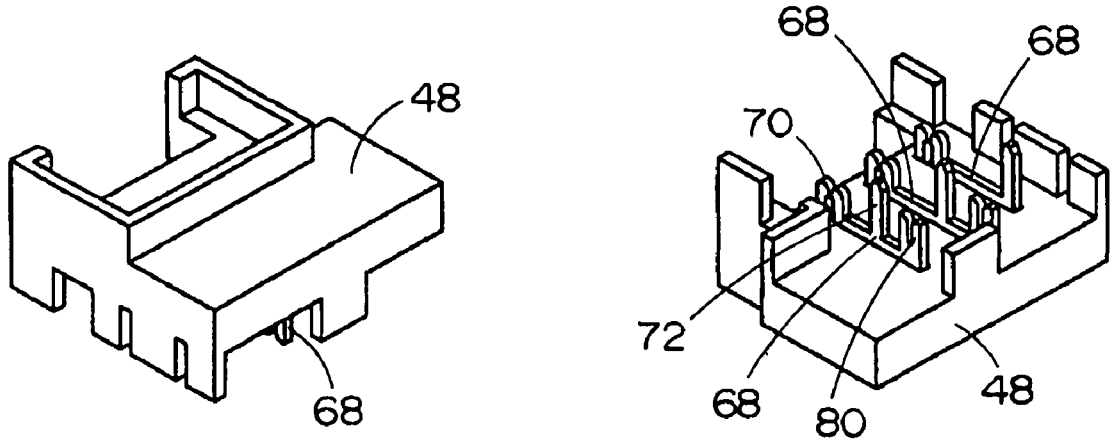
FIG. 15 is views showing a state in which a bridge connector is installed to a back lid in an assembling process for the connector shown in FIG. 8, FIG. 15(A) being a perspective view on the outer surface side, and FIG. 15(B) being a perspective view on the inner surface side.

Subsequently, as shown in FIG. 14, the electrical part 76 is incorporated in the electrical part housing portion 74, and the bridge connectors 68 are installed, whereby the bus wiring-side leads 28 of the communication control IC 24 and the female terminals 62 of the wire connectors are connected to each other, and the leads 78 of the electrical part 76 are connected. It is preferable that the bridge connectors 68 be installed in a state of being attached to the inside of the back lid 48 as shown in FIG. 15. This method is efficient because the bridge connectors 68 can be installed at the same time the back lid 48 is mounted.

The assembly is finished by carrying out the above procedure. If there arises the necessity of removing the communication control IC 24 for any reason after the assembly, the communication control IC 24 can be removed easily by merely removing the back lid 48 and the bridge connectors 68.

Figure 16:
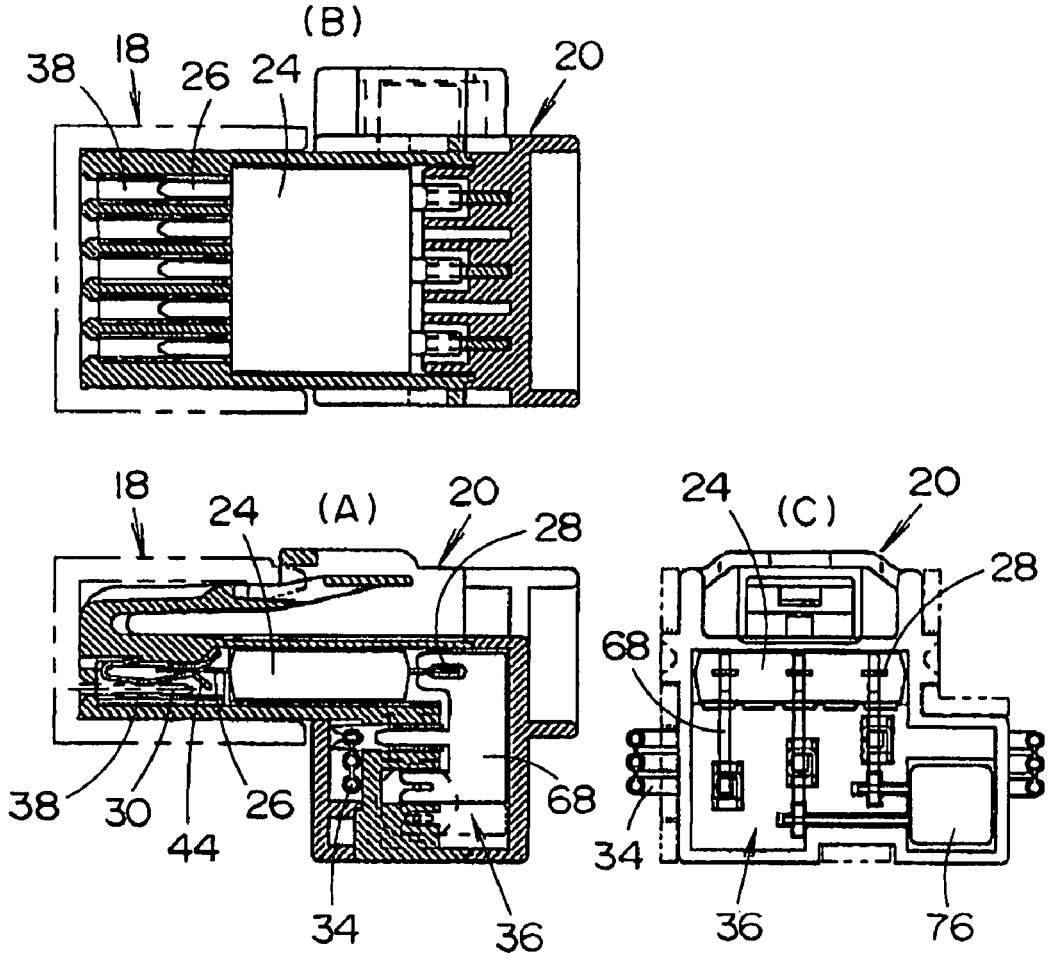
FIG. 16 is views showing a state in which an equipment-side connector is connected to the connector shown in FIG. 8, FIG. 16(A) being a longitudinal sectional view, FIG. 16(B) being a transverse sectional view, and FIG. 16(C) being a back view showing a state in which a back lid is removed.

FIG. 16 shows a state in which an equipment-side connector 18 (shown in two-dot chain line) is connected to the communication control IC-incorporating connector 20 configured as described above. The male terminal 30 of the equipment-side connector 18 is inserted in the two-way female connecting terminal 38, and the elastic tongue element 44 is pushed away by the male terminal 30 and comes firmly into contact with the equipment-side leads 26 with a contact pressure necessary for electrical connection.

In this embodiment, the solderless terminal 70 is formed on one end side of the bridge connector 68 so that the solderless terminal 70 is brought into contact with the bus wiring-side lead 28 of the communication control IC 24. However, on one end side of the bridge connector 68, for example, a female terminal may be formed in place of the solderless terminal 70.

Also, in this embodiment, the female terminal 62 is formed on the wire connector 60 side, and the male terminal 72 is formed on the bridge connector 68 side. However, inversely, a male terminal may be formed on the wire connector 60 side, and a female terminal may be formed on the bridge connector 68 side. Also, the connection of the wire connector 60 to the bridge connector 68 can be performed by a connecting means other than the connecting means using the female terminal and the male terminal. For example, a solderless terminal connected under pressure to a flat plate portion of the bridge connector 68 may be formed on the wire connector 60 side. In effect, the connecting means between the wire connector 60 and the bridge connector 68 has only to be a means that can connect the wire connector 60 to the bridge connector 68 by a pushing-in operation in the same direction when one end side of the bridge connector 68 is connected to the bus wiring-side lead 28 of the communication control IC 24.

According to the present invention, the equipment-side leads of the communication control IC are inserted from one end side into the two-way female connecting terminal attached to the housing, and the male terminal of the equipment-side connector is inserted from the other end side. Therefore, it is the two-way female connecting terminal that receives the inserting/drawing force of male terminal, and the inserting/drawing force of male terminal is not applied to the equipment-side leads of the communication control IC. For this reason, the communication control IC can be protected surely.

According to the present invention, when the equipment-side leads of the communication control IC are inserted in the two-way female connecting terminal, namely, at the stage at which the communication control IC is incorporated in the housing, the equipment-side leads of the communication control IC are inserted in the two-way female connecting terminal substantially with no insertion force. Therefore, the communication control IC can be protected more surely.

According to the present invention, the equipment-side leads of the communication control IC have only to be inserted in the two-way female connecting terminal, and the bus wiring-side leads of the communication control IC have only to be connected under pressure or pushingly connected to the cross connector. Therefore, connection by soldering, staking, or the like is unnecessary, and the incorporation of the communication control IC can be carried out easily. Also, the communication control IC has only to be incorporated after the two-way female connecting terminal and the cross connectors have been installed in the housing. Therefore, the expensive communication control IC can be incorporated at a later stage of connector assembling process, and if a trouble occurs during the connector assembling process, since the communication control IC is not incorporated, the waste of communication control IC can be reduced. Also, since the communication control IC can be removed after being incorporated, if a trouble occurs after the connector assembly, the communication control IC can be removed and recovered for reuse, which can improve the yield of assembling process. Further, a plurality of leads on the bus wiring side of the communication control IC and a plurality of electric wires of the bus wiring circuit can be connected selectively in a crossing portion, so that the connection pattern can be diversified, and the address of connector can be given not only by the communication control IC but also by the connection pattern of the connector and the electric wires.

According to the present invention, the connecting portion between the bus wiring-side lead of the communication control IC and the electric wire comes to a position offset from the engagement axis line of the connector. Therefore, when the connector engages with the equipment-side connector, the electric wire passing through the connector scarcely becomes a hindrance, so that automatic assembly of connector using a robot etc. can be carried out easily.

According to the present invention, the insertion of the equipment-side leads of the communication control IC in the two-way female connecting terminal and the pushing connection of the bus wiring-side leads thereof to the cross connectors can be carried out in the same direction at the same time. Therefore, the communication control IC can be incorporated more easily. Also, since the incorporated communication control IC can be removed easily, at the time when a trouble occurs, the expensive communication control IC can be recovered and reused.

According to the present invention, the size in the lead lengthwise direction of the connecting portion between the bus wiring-side lead of the communication control IC and the electric wire can be decreased, so that the connector can be made small in size.

According to the present invention, when the connector is connected to the equipment-side connector, a state in which the electric wires are pulled out of the connector toward the electric equipment side is formed. Therefore, there is little possibility that the electric wires are suspended in midair, and thereby damage caused by the hooking of wire can be prevented.

According to the present invention, the bus wiring-side leads of the communication control IC need not be bent, and moreover, the bus wiring-side leads of the communication control IC and the wire connectors can be connected to each other merely by pushing in the bridge connectors from one direction, so that the assembling work is easy to perform. Also, the communication control IC can be removed easily by pulling out the bridge connectors even after the connector assembly. Therefore, if a trouble occurs after the connector assembly, the communication control IC can be removed and recovered for reuse, so that the yield of assembling process can be improved.

According to the present invention, the bus wiring-side leads of the communication control IC can be connected to the wire connectors more easily and surely.

According to the present invention, when the electrical part is incorporated in the bus wiring-side connecting portion, the leads of the electrical part can be connected easily by the bridge connectors.

According to the present invention, a wiring harness with communication control IC-incorporating connector, which is suitable for on-board wiring etc. of a motor vehicle, can be obtained.

What is claimed is:

1. A connector incorporating communication control IC (Integrated Circuit) comprising:

a housing;

an equipment-side connecting portion for connecting an equipment-side lead of the communication control IC to a male terminal of an equipment-side connector, provided in an interior on a front end side of the housing;

a bus wiring-side connecting portion for connecting a bus wiring-side lead of the communication control IC to an electric wire of a bus wiring circuit, provided in an interior on a rear end side of the housing; and a two-way female connecting terminal incorporated in the equipment-side connecting portion, in which an insertion portion for the equipment-side lead of the communication control IC and an insertion portion for the male terminal of the equipment-side connector are provided alternately.

2. The communication control IC-incorporating connector according to claim 1, wherein the two-way female connecting terminal has an elastic tongue element which is formed so that in a state in which the male terminal of the equipment-side connector is not inserted, a contact pressure necessary for electrical connection is not applied to the equipment-side lead of the communication control IC, and when the male terminal is inserted, the elastic tongue element is pushed away by the male terminal so that a contact pressure necessary for electrical connection is applied to the equipment-side lead.

3. The communication control IC-incorporating connector according to claim 1, wherein in the bus wiring-side connecting portion, a plurality of electric wires of the bus wiring circuit are arranged in the direction such as to intersect a plurality of leads on the bus wiring-side of the communication control IC; and the leads and the electric wires to be connected are connected in a crossing portion thereof via a cross connector having a solderless terminal for connecting the leads under pressure on one end side thereof and a solderless terminal for connecting the electric wires under pressure on the other end thereof.

4. The communication control IC-incorporating connector according to claim 1, wherein in the bus wiring-side connecting portion, a plurality of electric wires of the bus wiring circuit are arranged in the direction such as to intersect a plurality of leads on the bus wiring side of the communication control IC; and the leads and the electric wires to be connected are connected in a crossing portion thereof via a cross connector having a connecting terminal for connecting the leads by pushing in the leads curvedly so as to decrease the width on one end side thereof and a solderless terminal for connecting the electric wires under pressure on the other end thereof.

5. The communication control IC-incorporating connector according to claim 1, wherein in the bus wiring-side connecting portion, a plurality of electric wires of the bus wiring circuit are arranged in the direction such as to intersect a plurality of leads on the bus wiring side of the communication control IC; and the leads and the electric wires to be connected are connected in a crossing portion thereof via a cross connector having an elastic contact element for connecting the leads by holding on one end side thereof and a solderless terminal for connecting the electric wires under pressure on the other end thereof.

6. The communication control IC-incorporating connector according to any one of claims 1 to 5, wherein in the bus wiring-side connecting portion, a plurality of leads on the bus wiring side of the communication control IC are bent in a plane perpendicular to the engagement axis line direction of the connector; a plurality of electric wires of the bus wiring circuit are arranged in the direction intersecting the bent leads; and the leads to be connected are connected to the electric wires in a crossing portion via a cross connector.

7. The communication control IC-incorporating connector according to claim 6, wherein the two-way female connecting terminal and the cross connector are installed in the housing so that the insertion of the equipment-side lead of the communication control IC in the two-way female connecting terminal and the pushing connection of the bus wiring-side lead thereof to the cross connector can be carried out from the same direction at the same time; and the communication control IC is incorporated in a state in which the equipment-side lead is inserted in the two-way female connecting terminal incorporated in advance and the bus wiring-side lead is connected to the cross connector.

8. The communication control IC-incorporating connector according to any one of claims 1 to 5, wherein a plurality of cross connectors are arranged by shifting the positions thereof so that the arrangement pitch is equivalent to the wire diameter in the lead lengthwise direction with intervals being provided in the lengthwise direction of the electric wire.

9. The communication control IC-incorporating connector according to claim 6, wherein an electric wire passing through the housing is pulled out of the bus wiring-side connecting portion toward the front end side of the connector.

10. The communication control IC-incorporating connector according to claim 1, wherein the bus wiring-side lead of the communication control IC extends in a straight line shape in the direction opposite to the equipment-side lead;

in the bus wiring-side connecting portion, wire connectors of the same number as that of the bus wiring-side leads, which have connection terminals arranged in parallel with the bus wiring-side lead on one end side thereof and a solderless terminal connected under pressure to the electric-wire on the other end side thereof, are incorporated;

the connection terminal of the wire connector and the bus wiring-side lead are connected one to one via a bridge connector extending between them; and to the solderless terminals of the wire connectors, a plurality of electric wires of the bus wiring circuit are connected under pressure one to one.

11. The communication control IC-incorporating connector according to claim 10, wherein the connection terminal of the wire connector consists of a female terminal or a male terminal; and the bridge connector has a solderless terminal connected under pressure to the bus wiring-side lead of the communication control IC on one end side thereof and a male terminal or a female terminal connected so as to correspond to the female terminal or the male terminal of the wire connector on the other end side thereof.

12. The communication control IC-incorporating connector according to claim 10, wherein in the bus wiring-side connecting portion, an electrical part is incorporated; and the bridge terminal has a solderless terminal connected under pressure to the lead of the electrical part.

13. A wiring harness, comprising:

a connector incorporating communication control IC (Integrated Circuit) comprising:

a housing;

an equipment-side connecting portion for connecting an equipment-side lead of the communication control IC to a male terminal of an equipment-side connector, provided in an interior on a front end side of the housing;

a bus wiring-side connecting portion for connecting a bus wiring-side lead of the communication control IC to an electric wire of a bus wiring circuit, provided in an interior on a rear end side of the housing: and a two-way female connecting terminal incorporated in the equipment-side connecting portion, in which an insertion portion for the equipment-side lead of the communication control IC and an insertion portion for the male terminal of the equipment-side connector are provided alternately;

wherein the communication control IC-incorporating connector is installed to an electric wire of a bus wiring circuit.

* * * * *